US008808152B1

(12) United States Patent
Midgett

(10) Patent No.: US 8,808,152 B1
(45) Date of Patent: Aug. 19, 2014

(54) EXERCISE RESISTANCE MACHINE

(76) Inventor: Trudy R. Midgett, Stumpy Point, NC (US)

( * ) Notice: Subject to any disclaimer, the term of this patent is extended or adjusted under 35 U.S.C. 154(b) by 198 days.

(21) Appl. No.: 13/550,077

(22) Filed: Jul. 16, 2012

Related U.S. Application Data

(60) Provisional application No. 61/508,183, filed on Jul. 15, 2011.

(51) Int. Cl.
*A63B 21/00* (2006.01)

(52) U.S. Cl.
USPC ..... 482/146; 482/51; 482/147

(58) Field of Classification Search
USPC ..... 482/96, 147, 146, 51, 72, 132
See application file for complete search history.

(56) References Cited

U.S. PATENT DOCUMENTS

| | | | | |
|---|---|---|---|---|
| 4,798,378 | A | 1/1989 | Jones | |
| 4,846,465 | A * | 7/1989 | Iams et al. | 482/132 |
| 4,858,918 | A * | 8/1989 | Iams et al. | 482/132 |
| 4,884,800 | A | 12/1989 | Duke | |
| 4,921,242 | A | 5/1990 | Watterson | |
| 4,989,850 | A * | 2/1991 | Weller | 270/1.02 |
| 5,312,315 | A | 5/1994 | Mortensen et al. | |
| 5,607,374 | A * | 3/1997 | Hesse | 482/51 |
| 6,752,745 | B1 | 6/2004 | Davis | |
| 6,830,542 | B2 | 12/2004 | Ball et al. | |
| 7,357,759 | B2 | 4/2008 | Bonnell | |
| 7,780,585 | B1 | 8/2010 | Rivas | |
| 8,052,583 | B1 * | 11/2011 | Tsai | 482/96 |
| 8,088,048 | B2 * | 1/2012 | Tsai | 482/96 |
| 2010/0062914 | A1 * | 3/2010 | Splane | 482/96 |
| 2011/0077137 | A1 * | 3/2011 | Tsai | 482/142 |

* cited by examiner

*Primary Examiner* — Jerome W Donnelly
(74) *Attorney, Agent, or Firm* — Robert C. Montgomery; Montgomery Patent & Design

(57) ABSTRACT

An exercise machine that facilitates exercises for a user's abdominal area, inner and outer thigh areas, upper body, and back areas includes a frame and a plurality of height adjustable legs which allow a user to selectively provide a comfortable height or inclined surface for personal exercise. The apparatus further includes a movable sliding platform assembly providing adjustable resistance. A pair of knee pads is pivotally affixed to the movable platform assembly and allows independent motioning in respective arcuate paths to exercise the user's oblique muscles. When the knee pads are motioned separately, the apparatus exercises the user's inner thigh, outer thigh, and stomach muscles. Additionally, the movable features of the apparatus enable a user to exercise various other specific body areas.

20 Claims, 10 Drawing Sheets

EXERCISE RESISTANCE MACHINE

RELATED APPLICATIONS

The present invention was first described in and claims the benefit of U.S. Provisional Patent No. 61/508,183 filed on Jul. 15, 2011, the entire disclosures of which are incorporated herein by reference.

FIELD OF THE INVENTION

The present invention relates generally to exercise equipment, and in particular, to a resistance exercise machine to simulate the act of rowing.

BACKGROUND OF THE INVENTION

Physical fitness and health concerns are among the areas of highest concern among Americans today. More than ever, people are frequenting health clubs and performing exercise routines at home in order to lose weight, improve muscle tone and maintain a healthy lifestyle. Often such workouts are intended for general body strengthening or rehabilitation after surgery.

Whatever the reason, there are literally thousands of different machines designed to strengthen and improve various muscle groups. Such machines strengthen arm and chest areas, while others concentrate on biceps and triceps areas, and yet others concentrate on back and shoulder or leg areas. Accordingly, equipment manufacturers are constantly looking for new exercise equipment designs which not only maximize workouts but provide such workouts to a maximum number of body areas. The development of the exercise resistance machine fulfills this need.

Various attempts have been made to provide a resistance rowing machine. Examples of these attempts can be seen by reference to several U.S. patents. U.S. Pat. No. 4,798,378, issued in the name of Jones, describes a rowing machine. This patent discloses an exercise machine having a flywheel and a one (1) way clutch. This patent does not disclose a stretchable resistance element or a kneepad assembly to provide oblique muscle exercises.

U.S. Pat. No. 4,884,800, issued in the name of Duke, describes a rowing machine. This patent discloses an exercise machine having a reservoir of water and a paddle assembly in order to provide resistance. This patent does not disclose a stretchable resistance element or a kneepad assembly to provide oblique muscle exercises.

U.S. Pat. No. 4,921,242, issued in the name of Watterson, describes an exercise apparatus resistance system. This patent discloses an exercise machine having a fluid cylinder connected to a moveable block and tackle in order to provide resistance. This patent does not disclose a stretchable resistance element or a kneepad assembly to provide oblique muscle exercises.

While these machines fulfill their respective, particular objectives, each of these references suffer from one (1) or more disadvantages. Many such machines are not suited for allowing independent motioning in respective arcuate paths to exercise oblique muscles. Accordingly, there exists a need for an exercise resistance machine without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a rowing machine that exercises the abdominal, inner thigh, outer thigh, gluteus maximus, upper body and back areas.

Accordingly, it is an object of the present embodiments of the invention to solve at least one (1) of these problems. The inventor has addressed this need by developing an exercise machine having a pair of knee pads pivotally affixed to a movable platform assembly allowing independent motioning in respective arcuate paths.

To achieve the above objectives, it is an object of the present invention to provide an apparatus designed to exercise the abdominal, inner thigh, outer thigh, gluteus maximus, upper body, and back areas of the body.

Another object of the present invention is where the apparatus comprises a front leg assembly and a rear leg assembly. In at least one (1) embodiment, the front leg assembly and the rear leg assembly comprise "U"-shaped structures affixed to a rectangular metal frame section.

Yet still another object of the present invention is where the leg assemblies rotate upon respective leg axle portions, are height adjustable, and provide a forward or reward inclined orientation for the frame section for increased resistance.

Yet still another object of the present invention is where the frame is attached to a mobile platform by means of a pair of slide assemblies.

Yet still another object of the present invention is where the mobile platform is attached to a pair of knee pads.

Yet still another object of the present invention is where the knee pads are capable of sideways motion with respect to the platform, are able to smoothly glide horizontally along the upper surface of the frame in an arcuate or linear direction, and are adjustable to a stationary position by means of a knee pad adjuster mechanism.

Yet still another object of the present invention is where the linear resistance of the mobile platform is adjustable by means of a platform resistance adjuster mechanism.

Yet still another object of the present invention is where the frame provides a secondary stationary kneepad assembly.

Yet still another object of the present invention where the frame further comprises a handlebar assembly comprising a grasping means and is length adjustable.

Yet still another object of the present invention is where the frame further comprises a pair of resistance cable handles.

Yet still another object of the present invention is where the cable handles may be pulled forwardly and motioned rearwardly in a repetitive manner, where the cable handles are worked independently from each other, and further comprise a pulley assembly, hook portions, and a resistance element.

Yet still another object of the present invention is where the resistance element comprises a linear flexible strap device having integral eyelet portions at each end.

Yet still another object of the present invention is to provide a method of utilizing the handlebar assembly portions of the apparatus in a linear manner that may be achieved by performing the following steps: procuring the apparatus; configuring the apparatus to perform a linear knee motion by tightening the knee pad adjustment knob to lock the mobile knee pads at a desired position with regards to the platform; kneeling upon the knee pads and grasping the grip portions of the handlebar assemblies; adjusting the platform resistance adjuster knob to obtain a desired amount of linear motion; motioning the platform forwardly and rearwardly in a repetitive manner to exercise abdominal muscles and various other muscle groups while using the apparatus.

Yet still another object of the present invention is to provide a method of utilizing the handlebar assembly portions of the apparatus in conjunction with a sideways knee pad motion that may be achieved by performing the following steps: configuring the apparatus to perform a sideways knee pad motion by loosening the knee pad adjustment knob to enable free arcuate motioning of both knee pads; kneeling upon said knee pads and grasping the grip portions of the handlebar assemblies; motioning one's knees from side-to-side while coincidentally motioning the platform in a linear forward and rearward direction; and, using various muscle groups including arms, upper legs, and abdominal muscles while motioning the platform for a desired period of time.

Yet still another object of the present invention is to provide a method of utilizing the cable handle portions of the apparatus in conjunction with previously described knee pad motions that may be achieved by performing the following steps: selecting a desired resistance element to install on the apparatus which results in a desired level of exertion; securing eyelet portions of said resistance element to the hook portions of the cable handles; positioning and locking the platform at a desired position along the slide assemblies by tightening the platform resistance adjuster knob; locking the knee pads at a desired position with regards to the platform by tightening the knee pad adjustment knob; kneeling on the knee pads as previously described; grasping the cable handles; utilizing the cable handles in a rowing-like or other motion by pulling the cable handles in a rearward direction while in the kneeling position; returning the cable handles to the forward "home" position; and, repeating the desired motion for a desired period of time. Additional exercises using the cable handles may be obtained by loosening of the knee pad adjustment knob, thereby providing additional side-to-side motion of one's knees while using said cable handles.

Yet still another object of the present invention is to provide a method of using the stationary knee pad in conjunction with the cable handles that may be achieved by performing the following steps: grasping and motioning said cable handles as previously described while motioning a combination of arms, torso, and waist areas as desired in a repetitive manner to exercise various muscles and muscle groups while utilizing said stationary knee pad.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
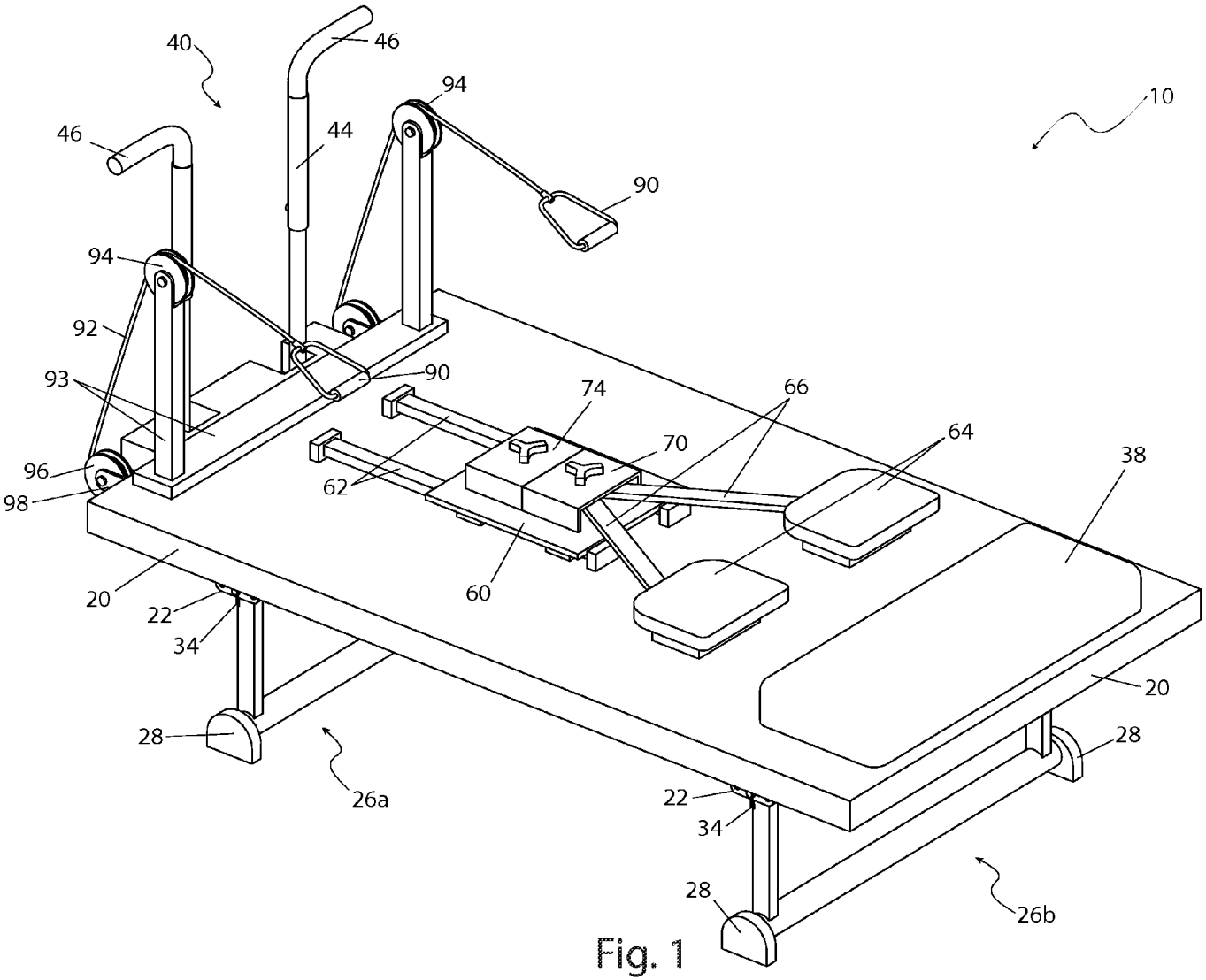
FIG. 1 is a rear perspective view of an exercise resistance machine 10, according to a preferred embodiment of the present invention.
Figure 2:
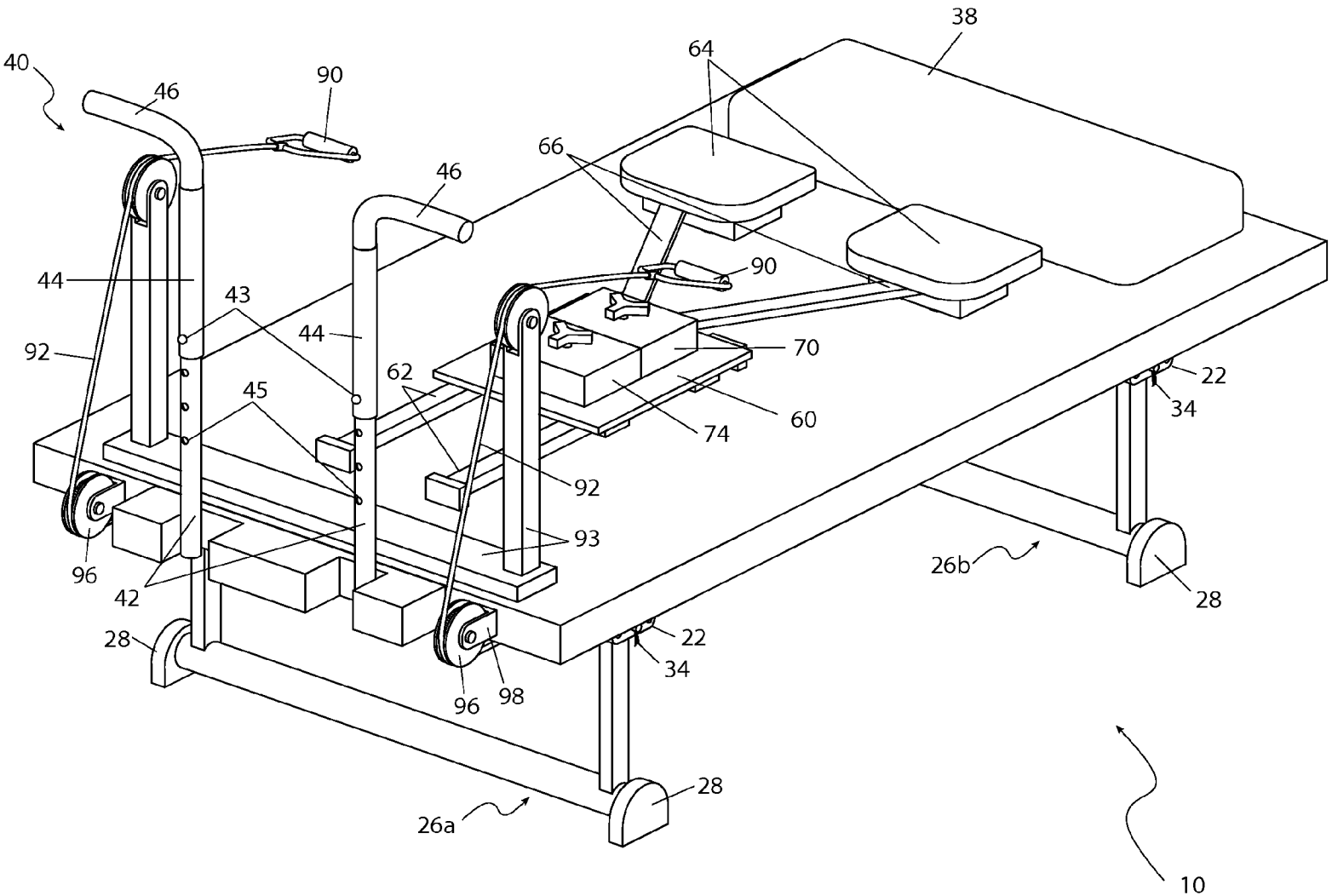
FIG. 2 is a front perspective view of the exercise resistance machine 10, according to a preferred embodiment of the present invention.
Figure 3:
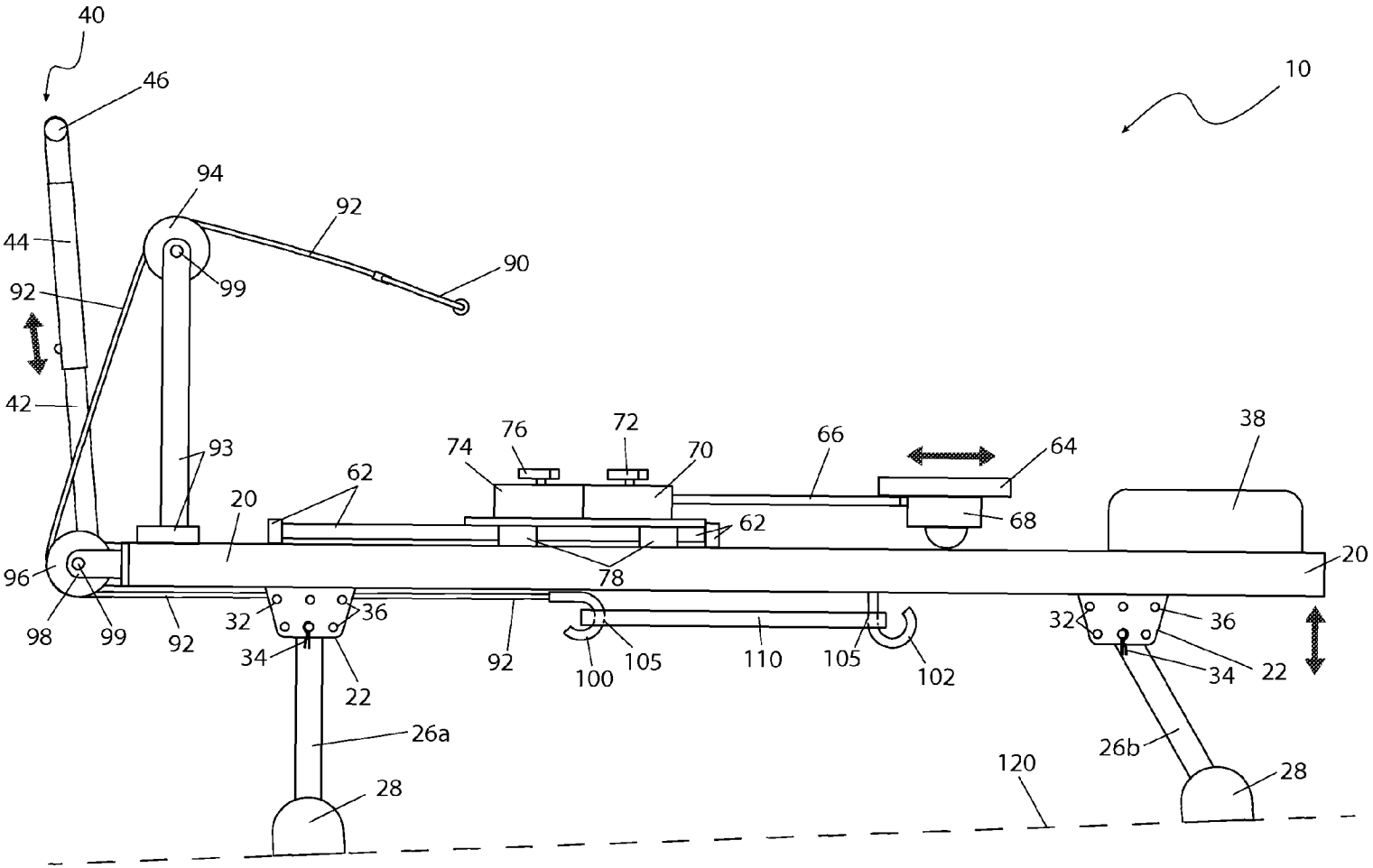
FIG. 3 is a side view of the exercise resistance machine 10, according to a preferred embodiment of the present invention.
Figure 4:
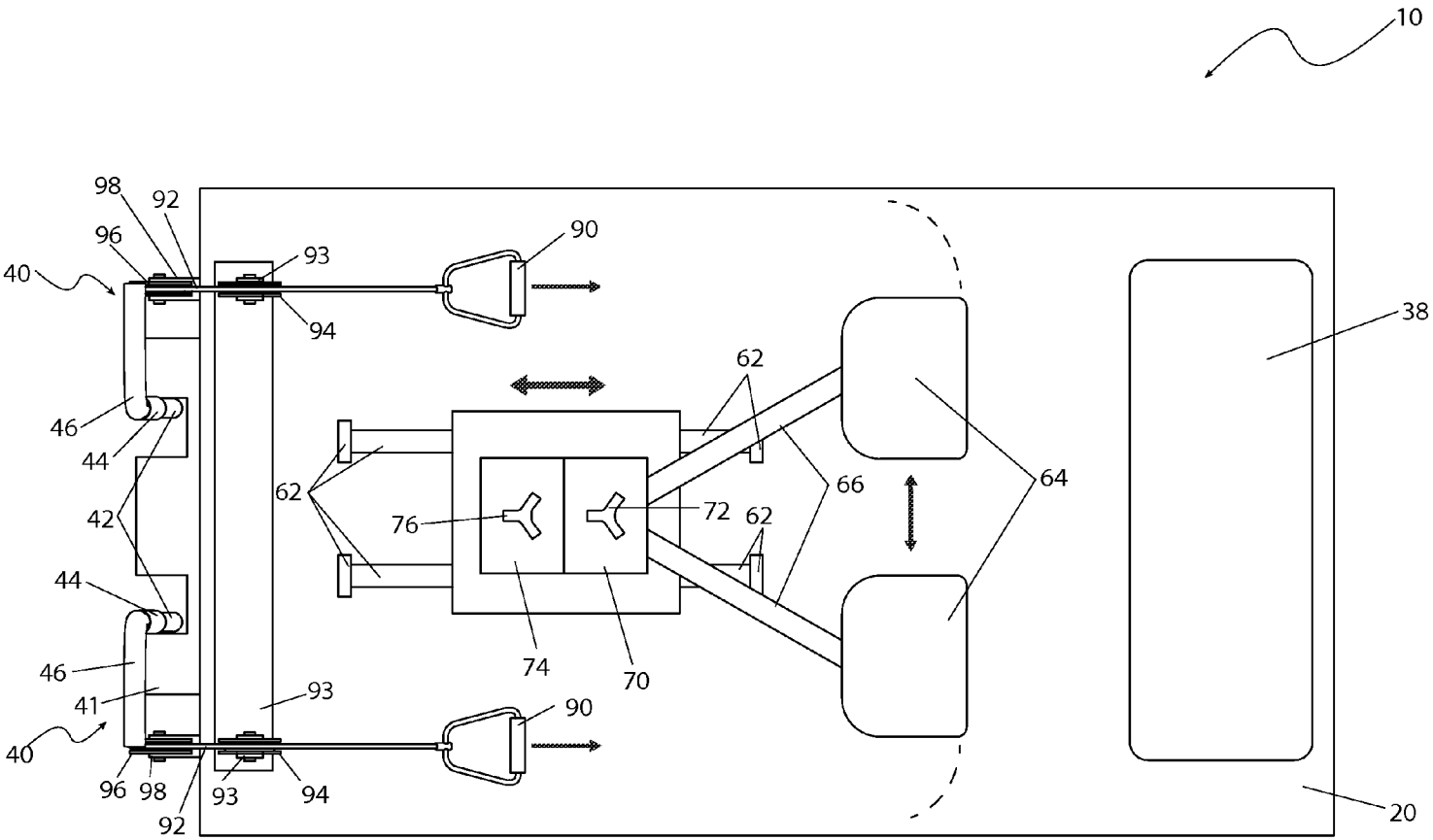
FIG. 4 is a top view of the exercise resistance machine 10, according to a preferred embodiment of the present invention.

10 exercise resistance machine
20 frame
22 leg bracket
26*a* front leg assembly
26*b* rear leg assembly
28 foot
32 leg axle
34 locking pin
36 fastener aperture
38 stationary knee pad
39 spring-loaded fastener
40 handlebar assembly
41 handlebar bracket
42 lower section
43 upper section aperture
44 upper section
45 lower section aperture
46 grip
60 platform
62 slide assembly
64 mobile knee pad
66 knee pad arm
68 roller
70 knee pad adjuster mechanism
72 knee pad adjustment knob
74 platform resistance adjuster mechanism
76 platform resistance adjuster knob
78 bearing
90 cable handle
92 cable
93 cable handle frame
94 first pulley
96 second pulley
98 pulley bracket
99 pulley shaft
100 first hook
102 second hook
105 eyelet
110 resistance element
120 floor surface
130 user

DETAILED DESCRIPTION OF THE PREFERRED EMBODIMENT

The best mode for carrying out the invention is presented in terms of its preferred embodiment, herein depicted within FIGS. 1 through 6*e*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, rear perspective, front perspective, side, and top views of an exercise resistance machine (herein described as the "apparatus") 10, according to a preferred embodiment of the present invention, are disclosed. The apparatus 10 provides an exercising machine which is designed to exercise areas of the body such as, but not limited to: an abdominal area, inner and outer thigh areas, gluteus maximus muscles, upper body, and back areas. The apparatus 10 comprises a front leg assembly 26*a* and a rear leg assembly 26*b*, each comprising "U"-shaped structures hingedly affixed to and extending downwardly from respective corner portions of a planar rectangular metal frame 20 portion. The leg assemblies 26*a*, 26*b* are envisioned to comprise unitary formed or welded structures made using rectangular cross-sectional tubing for vertical member portions, and a round tubing for a connecting horizontal member.

The frame 20 provides angular attachment to said leg assemblies 26*a*, 26*b* via respective pairs of integral downward extending leg brackets 22 located at bottom corner positions. The leg brackets 22 comprise inverted "U"-shaped structures which rotatingly captivate side portions of the rectangular tubular leg assemblies 26*a*, 26*b*. The leg assemblies 26*a*, 26*b* in turn rotate upon respective leg axle portions 32. The leg assemblies 26*a*, 26*b* are positioned and secured at a desired angle via insertion of quick-disconnect-type locking pins 34, or equivalent fastening means, which pass through a plurality of equal-spaced fastener apertures 36 formed through side surfaces of the leg brackets 22, thereby resulting in different angles. The forward and rearward motioning of the leg assemblies 26*a*, 26*b* results in independent adjustment of a height of respective front and rear edge portions of the frame 20 above a floor surface 120. The bottom horizontal member of each leg assembly 26*a*, 26*b* comprise half-moon-shaped rubber foot portions 28 being inserted upon opposing extending end portions via a friction-fit. Said leg assemblies 26*a*, 26*b* provide a means to position said frame 20 in a forward or rearward inclined orientation for increased training resistance, as well as providing a stable high-friction placement of the apparatus 10 upon a floor surface 120.

The frame 20 provides an attachment means to a mobile platform 60 via attachment to a pair of slide assemblies 62 arranged in a parallel manner via respective pillow-block-type bearings 78. The centrally located reciprocating platform 60 in turn provides an attachment means to a pair of rearwardly positioned mobile knee pads 64 via respective extending knee pad arm portions 66. Said knee pads 64 are envisioned to comprise cup-shaped structures having soft textile coverings which allow comfortable nesting of a user's knee portions within. Said knee pads 64 support knee portions of a kneeling user 130 while providing horizontal linear motioning of said user 130 while coincidentally grasping, pulling, and pushing upon a pair of stationary handlebars 40 which are securely mounted to a front edge of the frame 20 (see FIG. 5).

Additionally, the platform 60 comprises a knee pad adjuster mechanism 70 and a platform resistance adjuster mechanism 74, both mounted to a top surface to enable additional exercises. The mobile knee pads 64 may be secured at a stationary position by locking the knee pad arms 66 in place by tightening a knee pad adjustment knob 72 threadingly affixed to the knee pad adjuster mechanism 70, and the mobile platform 60 secured in position by tightening a platform resistance adjustment knob 76 portion being threadingly attached to the platform resistance adjuster mechanism 74 which acts upon the slide assembly 62. Securing the mobile knee pads 64 enables a user 130 to exercise upper body portions by grasping and extending a pair of resistance cable handles 90 secured to a forward portion of the frame 20 via a cable handle frame 93 (see FIG. 5).

The mobile knee pads 64 and respective connecting knee pad arms 66 enable independent sideways motioning of said mobile knee pads 64 with respect to the platform 60. Alternately, said sideways motioning of the knee pads 64 may be arrested by tightening down a knee pad adjustment knob portion 72 of the knee pad adjuster mechanism 70 which is affixed to a top surface of the platform 60. The sideways motion of the knee pads 64 provides a means to exercise oblique and other muscles when utilized with the previously described exercises. Additionally, said mobile knee pads 64 are envisioned to comprise a rotary "post-and-socket" connection to said knee pad arms 66, thereby allowing even greater freedom of motion while performing the previously described exercises.

Each knee pad 64 further comprises a subjacently-mounted ball-type roller 68 which acts upon a top surface of the frame 20 thereby allowing each knee pad 64 to smoothly glide horizontally along said upper surface of the frame 20 in an arcuate or linear direction while supporting a weight of the user 130 during exercising.

The platform resistance adjuster mechanism 74 provides a user 130 a means to adjust a linear resistance of the platform 60 as it moves in a linear path upon the frame 20. The platform resistance adjuster mechanism 74 is envisioned to comprise a friction device mounted along a bottom surface of the platform 60 which provides variable friction contact with the top surface of the frame 20. Said platform resistance adjuster mechanism 74 provides a means of resistance adjustment via a platform resistance adjuster knob 76. Additionally, said platform 60 may also be arrested in a stationary manner at a desired position by tightening said platform resistance adjuster mechanism 74 tightly against the frame 20.

The handlebar assemblies 40 are envisioned to comprise "L"-shaped tubular members mounted at a fixed upward angle upon a front portion of the frame 20 via a handlebar bracket 41. The handlebar assemblies 40 further comprise a length adjustment means via respective telescoping members including a lower section 42 and an upper section 44. Said handlebar sections 42, 44 are envisioned to be inserted into each other and secured at a desired length via aligning an upper section aperture 43 with a desired one (1) of a plurality of lower section apertures 43 and spring-loaded button fasteners 45 in a similar manner as tent poles, awnings, and the like. Said handlebar assemblies 40 further comprise ergonomic rubber or soft plastic gripping portions 46 at upper end portions, thereby providing a user 130 a secure high-friction grasping means while performing said exercises.

The apparatus 10 comprises a stationary knee pad portion 38 mounted upon the top surface of the frame 20 at a rearward position, allowing a user 130 an additional rearward kneeling position, in addition to the aforementioned mobile knee pads 64. Said stationary knee pad 38 is envisioned to comprise a comfortable rectangular textile assembly and is envisioned to be utilized in conjunction with the handlebar assemblies 40 and cable handle 90 portions of the apparatus 10 in lieu of the aforementioned mobile knee pads 64 to exercise various muscle groups.

Figure 5:
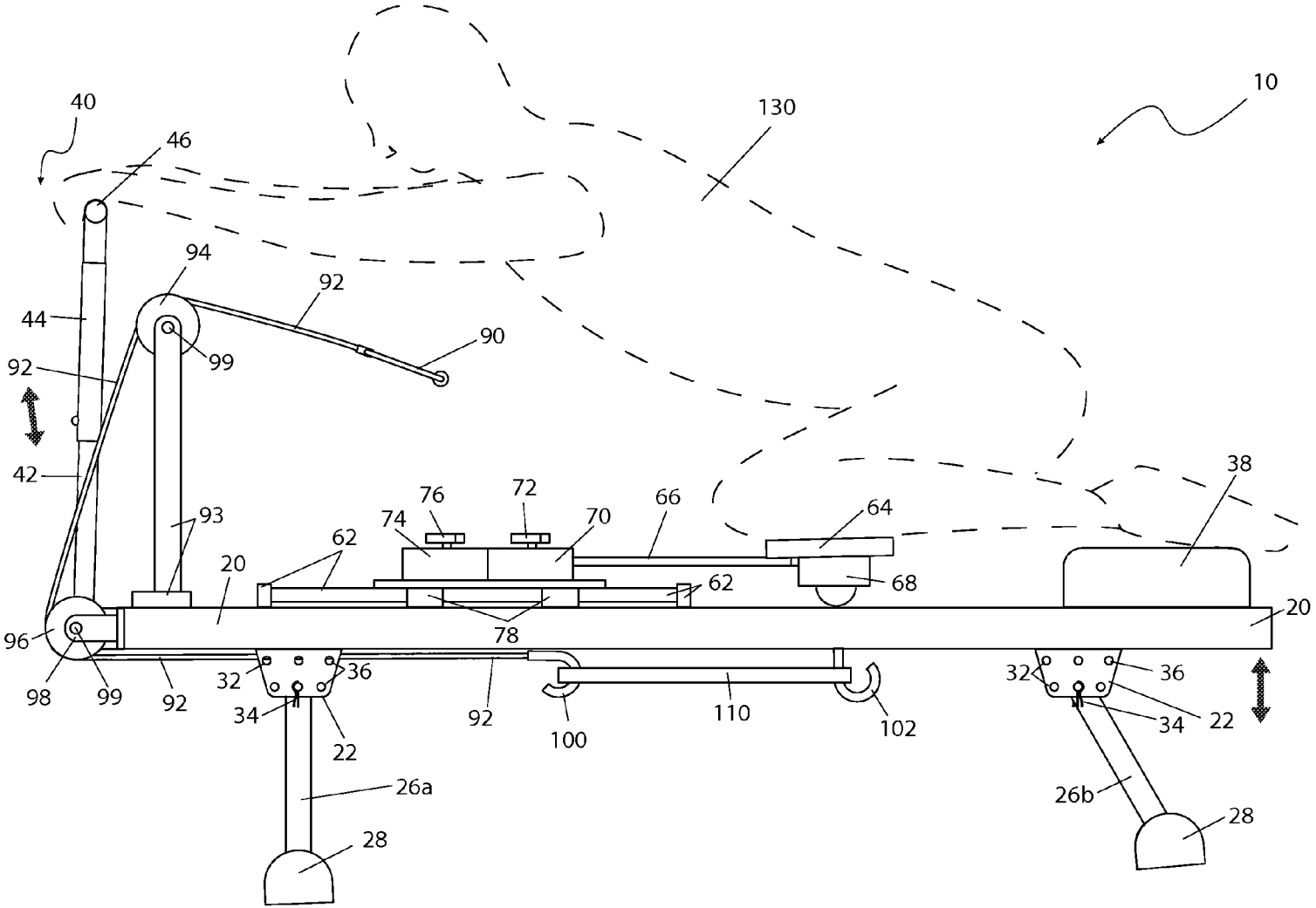
FIG. 5 is an environmental view of the exercise resistance machine 10, according to a preferred embodiment of the present invention.
Figure 6A:
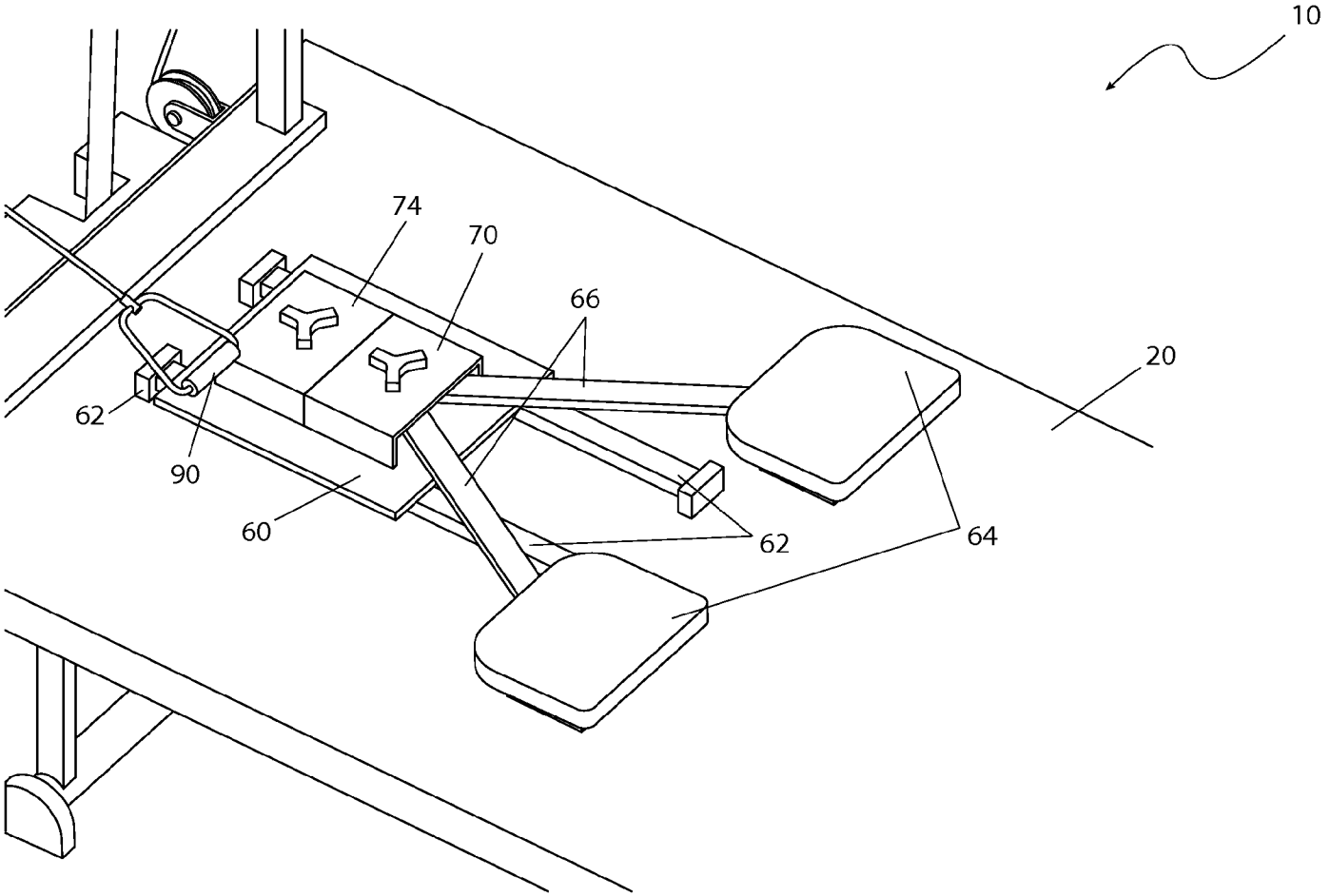
FIG. 6*a* is a perspective view of the exercise resistance machine 10 depicting a forward position of mobile knee pad portions 64, according to a preferred embodiment of the present invention.
Figure 6B:
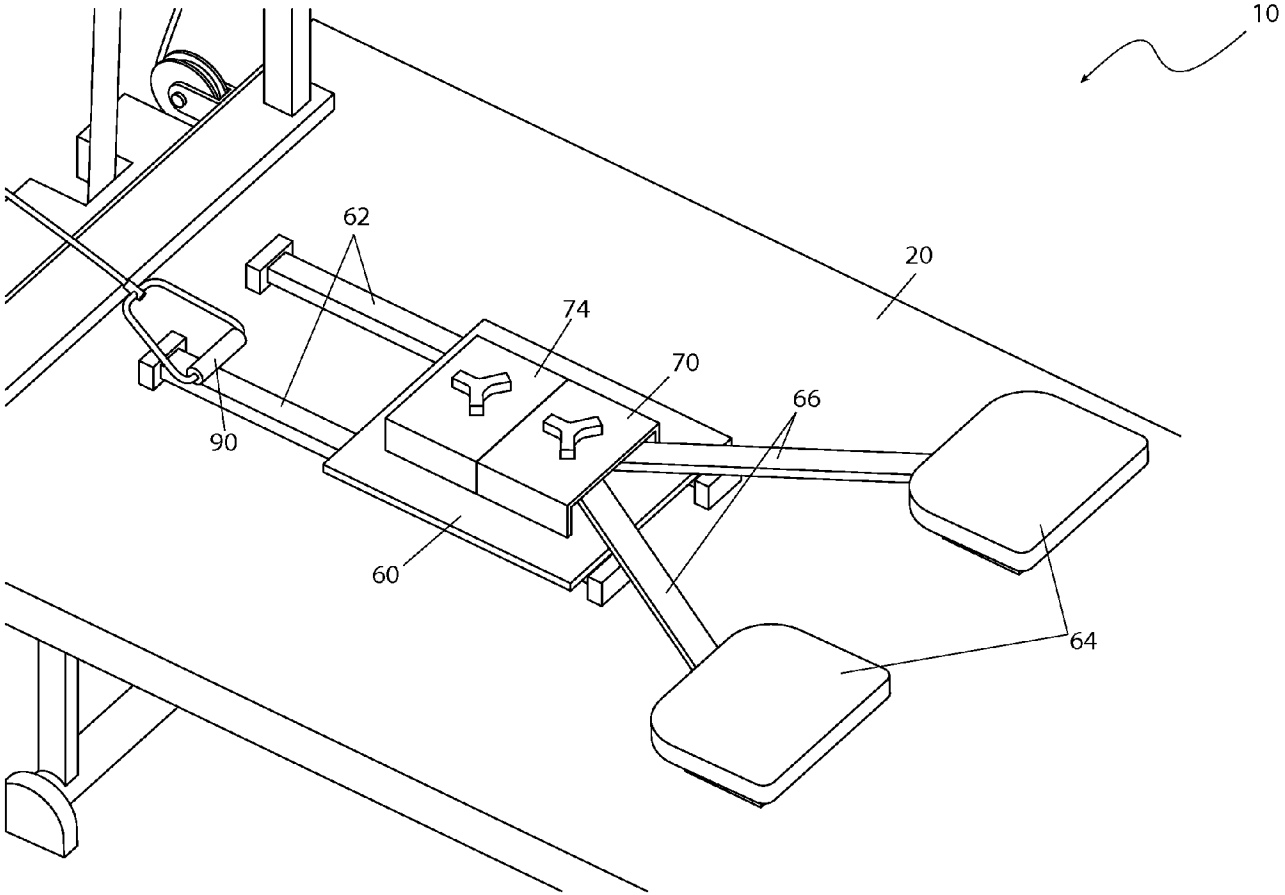
FIG. 6*b* is a perspective view of the exercise resistance machine 10 depicting a rearward position of the mobile knee pad portions 64, according to a preferred embodiment of the present invention.
Figure 6C:
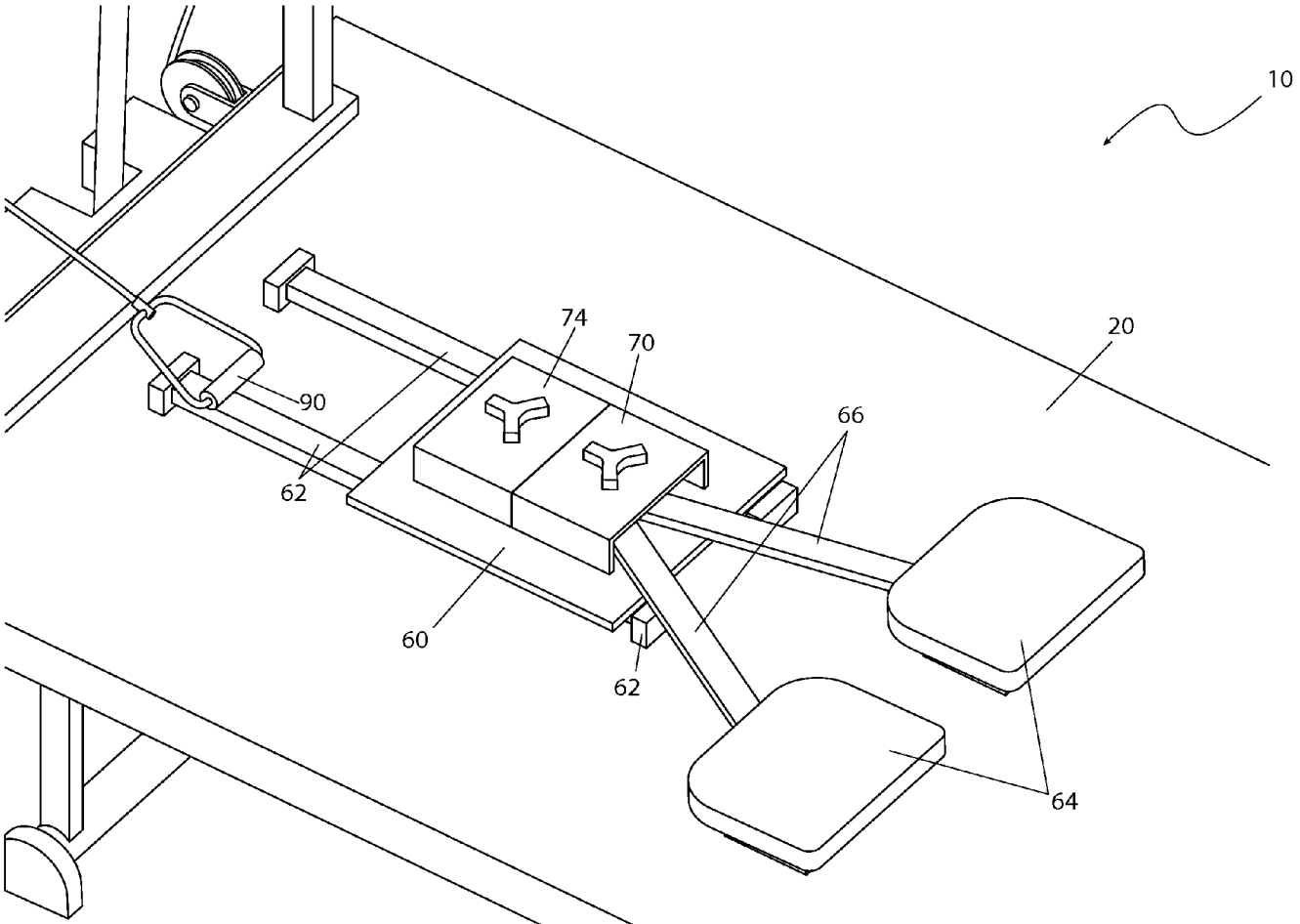
FIG. 6*c* is a perspective view of the exercise resistance machine 10 depicting pivoted leftward mobile knee pad portions 64, according to a preferred embodiment of the present invention.
Figure 6D:
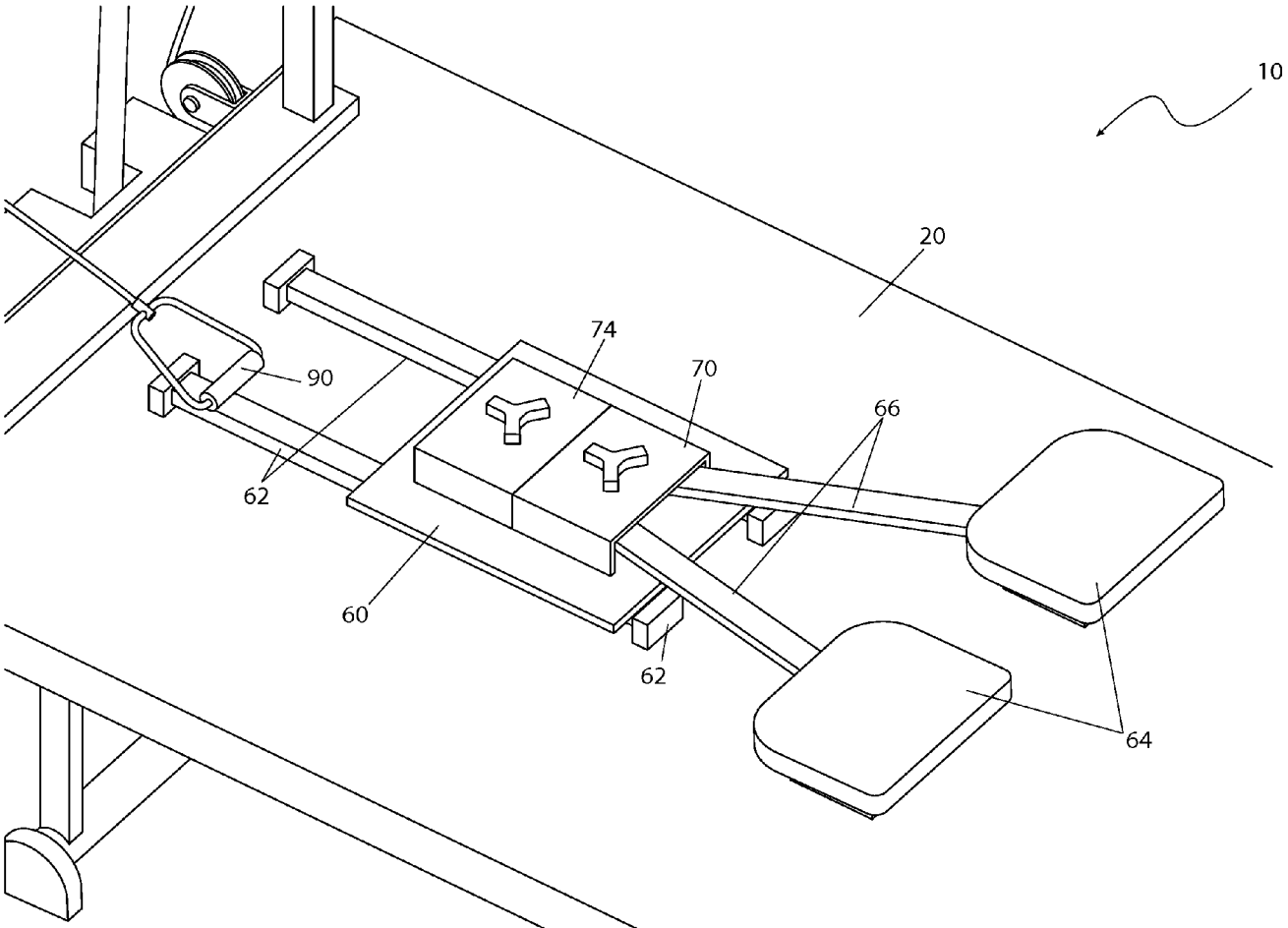
FIG. 6*d* is a perspective view of the exercise resistance machine 10 depicting pivoted rightward mobile knee pad portions 64, according to a preferred embodiment of the present invention; and, FIG. 6*e* is a perspective view of the exercise resistance machine 10 depicting spread mobile knee pad portions 64, according to a preferred embodiment of the present invention.
Figure 6E:
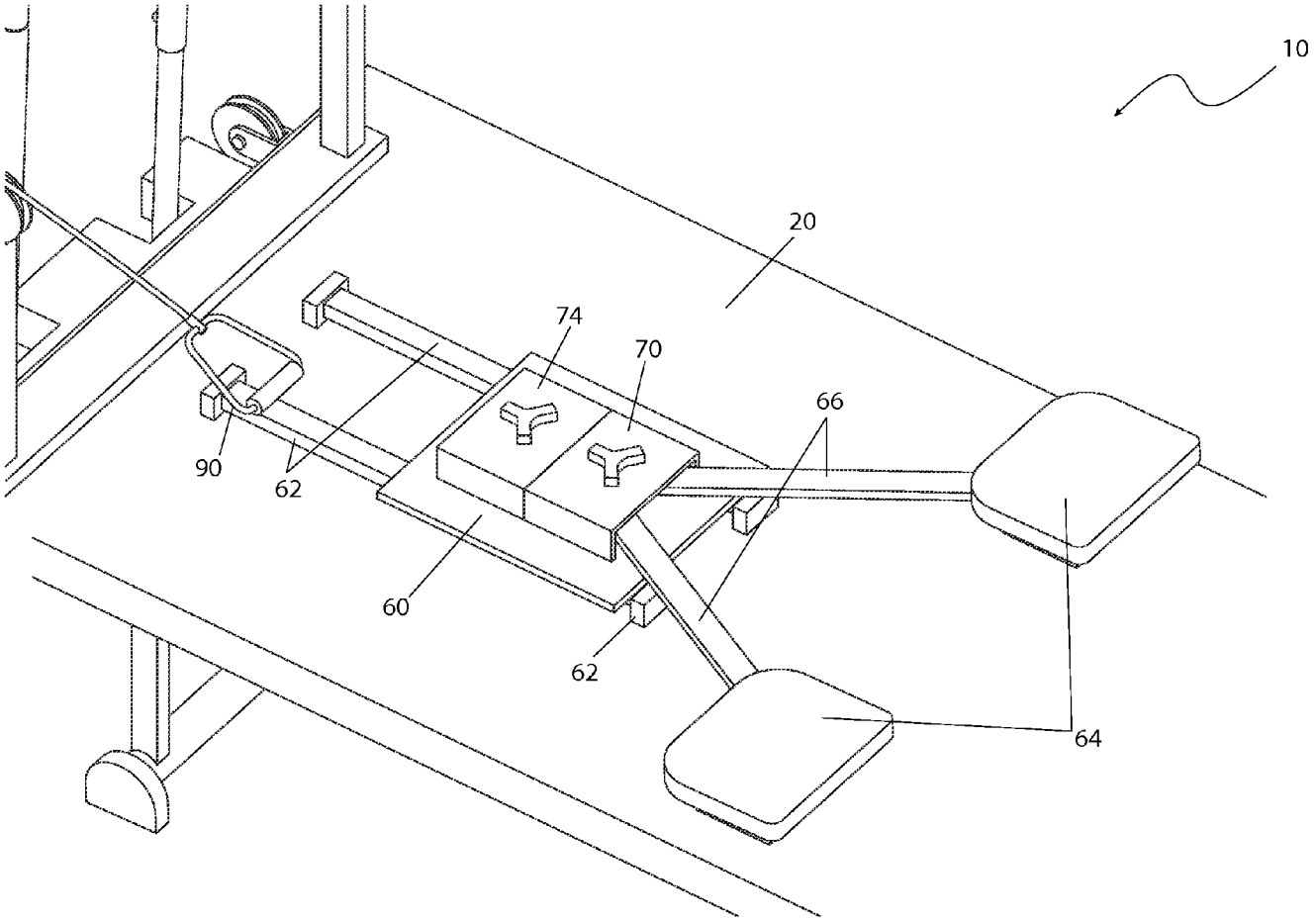

Referring now to FIG. 5, an environmental view of the apparatus 10 depicting use of the cable handles 90 by a user 130, according to a preferred embodiment of the present invention, is disclosed. The cable handles 90 may be pulled forwardly and motioned rearwardly in a repetitive manner by a user 130 while kneeling upon the mobile knee pads 64, being in a desired position and secured in a stationary state using the knee pad adjuster 70 and platform resistance adjuster 74 mechanisms. Said cable handles 90 work independently from each other in a parallel manner and further comprise respective resistance means via an assembly of members including a cable 92, a first pulley 94, a second pulley 96, a pulley bracket 98, a first hook 100, a second hook 102, and a resistance element 110. Said first 94 and second 96 pulleys are mounted to the aforementioned cable handle frame 93 via respective pulley shafts 99, thereby redirecting the cable 92 downwardly around a front edge of the frame 20 and under said frame 20 where it is in turn connected to the synthetic resistance element 110 via the first hook 100. The resistance element 110 is envisioned to comprise a linear flexible strap device having integral eyelet portions at each end. Said resistance element 110 is envisioned to be made using rubber, urethane, or other equivalent stretchable material and is removably secured to said first hook portion 100 of the cable 92 and to a stationarily mounted second hook 102 being permanently affixed to a rearward bottom surface of the frame 20. It is envisioned that different resistance elements 110 may be provided which have various durometers and cross-sectional areas, thereby providing a user 130 varying ranges of stretching resistance while extending said cable handles 90 when exercising.

Referring now to FIGS. 6*a* through 6*e*, various perspective views of the mobile knee pads 64 in various exercising positions, according to a preferred embodiment of the present invention, are disclosed. These views illustrate the forward (FIG. 6*a*), rearward (FIG. 6*b*), leftward (FIG. 6*c*), rightward (FIG. 6*d*), and spread (FIG. 6*e*) positions of the mobile knee pads 64 being coincidentally available to a user 130, thereby allowing a user 130 to create an infinite number of sequential and directional exercises as well as varying an amount of exertion by utilizing the previously described movement resistance features of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user 130 in a simple and effortless manner with little or no training. After initial purchase or acquisition of the apparatus 10, it would be installed as indicated in FIG. 1.

The method of utilizing the handlebar assembly portions 40 of the apparatus 10 in a linear manner may be achieved by performing the following steps: procuring the apparatus 10; configuring the apparatus 10 to perform a linear knee motion by tightening the knee pad adjustment knob 72 to lock the mobile knee pads 64 at a desired position with regards to the platform 60; kneeling upon the knee pads 64 and grasping the grip portions 46 of the handlebar assemblies 40; adjusting the platform resistance adjuster knob 76 to obtain a desired amount of linear motion resistance acting between the slide assemblies 62 and the platform 60; motioning the platform 60 forwardly and rearwardly in a repetitive manner to exercise abdominal muscles and various other muscle groups while using the apparatus 10.

The method of utilizing the handlebar assembly portions 40 of the apparatus 10 in conjunction with a sideways knee pad 64 motion may be achieved by performing the following steps: configuring the apparatus 10 to perform a sideways knee pad 64 motion by loosening the knee pad adjustment knob 72 to enable free arcuate motioning of both knee pads 64; kneeling upon said knee pads 64 and grasping the grip portions 46 of the handlebar assemblies 40; motioning one's knees from side-to-side while coincidentally motioning the platform 60 in a linear forward and rearward direction; and, using various muscle groups including arms, upper legs, and abdominal muscles while motioning the platform 60 for a desired period of time.

The method of utilizing the cable handle portions 90 of the apparatus 10 in conjunction with previously described knee pad 64 motions may be achieved by performing the following additional steps: selecting a desired resistance element 110 to install on the apparatus 10 which results in a desired level of exertion; securing eyelet portions of said resistance element 110 to the first 100 and second 102 hook portions; positioning and locking the platform 60 at a desired position along the slide assemblies 62 by tightening the platform resistance adjuster knob 76; locking the knee pads 64 at a desired position with regards to the platform 60 by tightening the knee pad adjustment knob 72; kneeling on the knee pads 64 as previously described; grasping the cable handles 90; utilizing the cable handles 90 in a rowing-like or other motion by pulling the cable handles 90 in a rearward direction while in the kneeling position; returning the cable handles 90 to the forward "home" position; and, repeating the desired motion for a desired period of time. Additional exercises using the cable handles 90 may be obtained by loosening of the knee pad adjustment knob 72, thereby providing additional side-to-side motion of one's knees while using said cable handles 90.

The method of using the stationary knee pad 38 in conjunction with the cable handles 90 may be achieved by performing the following additional steps while kneeling upon said stationary knee pad 38: grasping and motioning said cable handles 90 as previously described while motioning a combination of arms, torso, and waist areas as desired in a repetitive manner to exercise various muscles and muscle groups while utilizing said stationary knee pad 38.

Furthermore, the knee pads 64 may be motioned separately to exercise one's inner thighs, outer thighs, and stomach muscles. Other related motions may enhance other specific body areas. Various knee placement and motions provide the ability to tone upper body and back areas as well. Finally, the apparatus 10 may be utilized for various other purposes such as, but not limited to: reducing accidental injuries, building strength in specific muscle groups, burning fat, and providing a cardio workout. The apparatus 10 may be used by adults and also children under proper supervision. The apparatus 10 may also be used by those who are disabled or undergoing therapy.

In addition to the previously described specific configurations of the apparatus 10 and specific exercise examples, it is envisioned that the features of the apparatus 10 may be utilized in any number of ways to provide benefit to a user 130 and as such should not be interpreted as a limiting factor of the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An exercise machine, comprising:

a frame, comprising a first end having a first leg assembly and a second end having a second leg assembly each attached to a bottom portion thereof;

a pair handlebar assemblies affixed to said first end of said frame and disposed vertically, each equidistant from a longitudinal bisecting centerline of said frame;

a stationary knee pad affixed to said second end of said frame on an upper surface thereof;

a platform assembly movable relative to said frame, located on an intermediate location on an upper portion of said frame;

a pair of knee assemblies pivotally affixed to said platform assembly;

a movable knee pad attached to each of said pair of knee assemblies; and, a pair of resistance mechanisms attached to said frame, each equidistant from a longitudinal bisecting centerline of said frame;

wherein said pair of knee assemblies are independently movable in arcuate paths relative to said platform assembly; and, wherein said pair of resistance mechanisms provides independent and selective resistance upon relative movement thereof by a user.

2. The exercise machine of claim 1, wherein said first leg assembly and said second leg assembly each comprise a leg axle portion pivotally affixed to said frame;

wherein said first leg assembly and said second leg assembly each comprise a securing means for securing said first leg assembly and said second leg assembly at a desired angle; and, wherein said first leg assembly and said second leg assembly each provide an inclined orientation for said frame relative to a ground surface.

3. The exercise machine of claim 2, wherein said first leg assembly and said second leg assembly are each height adjustable.

4. The exercise machine of claim 3, wherein said first leg assembly and said second leg assembly each further comprise a generally "U"-shaped structure.

5. The exercise machine of claim 1, wherein said platform assembly further comprises a platform member slidably motioning upon a pair of slide assemblies affixed to said frame.

6. The exercise machine of claim 5, further comprising a platform securing device for securing a desired position of said platform member relative to said pair of slide assemblies.

7. The exercise machine of claim 1, wherein each of said movable knee pads further comprises a roller on a bottom end thereof for contacting an upper surface of said frame.

8. The exercise machine of claim 7, further comprising a knee pad securing device for securing a desired position of said pair of knee assemblies relative to said platform assembly.

9. The exercise machine of claim 1, wherein said handlebar assembly comprises generally "L"-shaped tubular members.

10. The exercise machine of claim 1, wherein said handlebar assembly further comprises:

a height adjustable means located at a vertical portion thereof; and, an ergonomic gripping means at a horizontal portion thereof.

11. The exercise machine of claim 1, wherein said pair of resistance mechanisms each further comprises:

a cable, having a first end and a second end;

a resistance element having a first end removably attached to said cable first end and a second end removably attached to a bottom portion of said frame;

a first pulley mounted to said frame first end in a vertical orientation via a first pulley bracket; and, a second pulley mounted to said frame first end in a horizontal orientation via a second pulley bracket;

wherein said first pulley and said second pulley are vertically aligned;

wherein said cable is routed through said first pulley and said second pulley; and, wherein said resistance element provides a resistant force when said cable is motioned towards said second end of said frame.

12. The exercise machine of claim 11, further comprising a cable handle located at said cable second end.

13. The exercise machine of claim 11, wherein said resistance element further comprises a linear flexible strap having integral eyelet portions at each said resistance element first and second end.

14. An exercise machine, comprising:

a frame, comprising a first end having a height-adjustable first leg assembly and a second end having a height-adjustable second leg assembly each attached to a bottom portion thereof;

a pair height-adjustable handlebar assemblies affixed to said first end of said frame and disposed vertically, each equidistant from a longitudinal bisecting centerline of said frame;

a stationary knee pad assembly affixed to said second end of said frame on an upper surface thereof;

a platform assembly movable relative to said frame, located on an intermediate location on an upper portion of said frame;

a pair of knee assemblies pivotally affixed to said platform assembly;

a movable knee pad attached to each of said pair of knee assemblies further comprising a roller on a bottom end thereof for contacting an upper surface of said frame; and, a pair of resistance mechanisms attached to said frame, each equidistant from a longitudinal bisecting centerline of said frame;

wherein said pair of knee assemblies are independently movable in arcuate paths relative to said platform assembly; and, wherein said pair of resistance mechanisms provides independent and selective resistance upon relative movement thereof by a user.

15. The exercise machine of claim 14, wherein said platform assembly further comprises:

a platform member slidably motioning upon a pair of slide assemblies affixed to said frame;

a platform securing device for securing a desired position of said platform member relative to said pair of slide assemblies; and, a knee pad securing device for securing a desired position of said pair of knee assemblies relative to said platform member.

16. The exercise machine of claim 15, wherein said first leg assembly and said second leg assembly each comprise a leg axle portion pivotally affixed to said frame;

wherein said first leg assembly and said second leg assembly each comprise a securing means for securing said first leg assembly and said second leg assembly at a desired angle; and, wherein said first leg assembly and said second leg assembly each provide an inclined orientation for said frame relative to a ground surface.

17. The exercise machine of claim 16, wherein said first leg assembly and said second leg assembly each further comprise a generally "U"-shaped structure.

18. The exercise machine of claim 15, wherein said handlebar assembly comprises generally "L"-shaped tubular members and further comprises an ergonomic gripping means at a horizontal portion thereof.

19. The exercise machine of claim 15, wherein said pair of resistance mechanisms each further comprises:

a cable, having a first end and a second end;

a resistance element having a first end removably attached to said cable first end and a second end removable attached to a bottom portion of said frame;

a first pulley mounted to said frame first end in a vertical orientation via a first pulley bracket;

a second pulley mounted to said frame first end in a horizontal orientation via a second pulley bracket; and, a cable handle located at said cable second end;

wherein said first pulley and said second pulley are vertically aligned;

wherein said cable is routed through said first pulley and said second pulley; and, wherein said resistance element provides a resistant force when said cable is motioned towards said second end of said frame.

20. The exercise machine of claim 19, wherein said resistance element further comprises a linear flexible strap having integral eyelet portions at each said resistance element first and second end.

* * * * *